US005183305A

United States Patent [19]

Nordstrom et al.

[11] Patent Number: 5,183,305

[45] Date of Patent: Feb. 2, 1993

[54] METHOD AND APPARATUS FOR HANDLING CARGO CONTAINERS

[76] Inventors: Immo R. Nordstrom, 153 Kemp Ave., Fair Haven, N.J. 07704; Johannes A. Bak, 6706AK, Wageningen, Netherlands

[21] Appl. No.: 809,817

[22] Filed: Dec. 5, 1991

Related U.S. Application Data

[63] Continuation of Ser. No. 451,333, Dec. 18, 1989, abandoned.

[51] Int. Cl.[5] ..... B66C 1/10

[52] U.S. Cl. ..... 294/81.2; 294/81.1

[58] Field of Search ..... 294/68.3, 81.1, 81.2, 294/81.21, 81.5, 81.53; 414/607, 608

[56] References Cited

U.S. PATENT DOCUMENTS

| | | | |
|---|---|---|---|
| 3,365,229 | 1/1968 | Hitch et al. | 294/81.1 |
| 3,494,486 | 2/1970 | Knight, Jr. et al. | 294/81.1 |
| 3,502,365 | 3/1970 | Callow | 294/81.1 |
| 3,536,351 | 10/1970 | Zweifel et al. | 294/81.1 |
| 3,578,374 | 5/1971 | Glassmeyer | 294/81.53 |
| 3,709,543 | 1/1973 | Tax et al. | 294/81.2 |
| 3,726,426 | 4/1973 | Tingskog | 294/81.1 X |
| 3,747,970 | 7/1973 | Fathauer et al. | 294/81.1 |
| 4,068,878 | 1/1978 | Wilner | 294/81.53 |
| 4,221,515 | 9/1980 | Brown et al. | 294/81.1 |
| 4,341,495 | 7/1982 | Del'Acqua | 294/81.53 |

FOREIGN PATENT DOCUMENTS

| | | | |
|---|---|---|---|
| 1951531 | 5/1971 | Fed. Rep. of Germany | 294/81.2 |

*Primary Examiner*—Johnny D. Cherry

*Attorney, Agent, or Firm*—Roylance, Abrams, Berdo & Goodman

[57] ABSTRACT

Two spreaders are liftable by a crane apparatus and are provided with coupling devices for attachment to cargo containers, and separate latching devices to couple the spreaders to each other, end-to-end and slightly spaced apart. The length of each spreader is the same as the length of a shorter cargo container to be handled. The total length of the two spreaders, including the spacing, is the same as the length of a longer (double-size) container. When coupled together, the spreaders are used to lift and place either two of the shorter containers together or one longer container. Containers of different heights can also be handled.

18 Claims, 6 Drawing Sheets

METHOD AND APPARATUS FOR HANDLING CARGO CONTAINERS

This is a continuation of application Ser. No. 07/451,333 filed Dec. 18, 1989, now abandoned.

FIELD OF THE INVENTION

The present invention relates to a method and apparatus for handling cargo containers of different sizes in loading and unloading cargo ships.

BACKGROUND OF THE INVENTION

It has been customary for some time to provide cargo containers to hold material transported by ships. These cargo containers are large rectangular parallelepipeds which are filled on land, either at the dockside or at some other location, with articles to be shipped. The containers are then moved to a location at the dockside for loading into the cargo hold of a ship. At the destination, the containers are removed from the cargo hold, placed on the dock and then either unloaded or transported to an unloading site. Most often, the containers are moved away from dockside before unloading.

The cargo containers of this type are rather large and cumbersome and are handled by large cranes on the ship or by dockside cranes, commonly of the type mounted on rails for dockside transport, for loading and unloading. The physical properties of the container are standardized according to the standards set by the International Standards Organization (ISO). The containers can vary in length from about 10 feet (3.05 m.) to about 40 feet (12.19 m.) and in height from about 8 feet (2.44 m.) to about 9'6", and the rated gross mass (loaded) can vary from about 22,000 lbs. (10,000 Kilograms) to about 68,000 lbs. (31,000 kilograms). The width is generally 8 feet for any size container. These figures are provided only by way of example and are not intended to be representative of any specific type of containers. Various shipping lines use containers of different sizes.

However, containers and cargo holds are designed and dimensioned to mate with each other, so that the lateral dimensions of the cells or compartments in the ship's hold are very closely matched to the lateral (length and width) dimensions of the standard containers. Thus, if a specific shipping line is using 20' and 40' long containers, the hold compartments are designed to be only a few inches longer than 40' and are provided with holding structures to prevent lateral or longitudinal shifting of the containers while the ships are under way. The heights of these containers are, however, still variable.

It is also conventional to use devices known as spreaders to facilitate handling of the cargo containers. These spreaders are generally rectangular frames having outer dimensions equal in length and width to the corresponding dimensions of the cargo container being handled. Each spreader is lifted by steel cables suspended from a crane such that the container is maintained in a horizontal position regardless of the distribution of mass of the payload in the container. Alternatively, vertical cables connected to hoisting drums of the crane are attached to the four corners of each of the two spreaders.

The spreaders and containers are also usually provided with cooperative mechanisms for engaging the cargo containers. One such mechanism includes elongated slots in the upper surface of the containers near the corners thereof and downwardly extending inverted T-shaped twist lock members at the corners of the spreader. The spreader also has means for rotating the T-shaped members so that, after the spreader has been lowered to the container top and the heads of the members have passed through the elongated holes, the members can be rotated to lock the spreader to the container. The spreader and container can then be lifted, as a unit, into or out of the ship's hold.

As will be apparent from this brief description, the spreader to be used in loading or unloading containers from a ship must be the same size as the top surface of a cargo container. Thus, a 20' spreader could only be used to pick up a 20' container, a 40' spreader could only be used to pick up a 40' container, etc. This presents somewhat of a problem because, if a mixed group of 20' and 40' containers are to be removed from a hold, it is quite slow and therefore expensive to handle each 20' container separately with a 20' spreader and change spreaders to handle to the 40' containers. It is, however, not possible to simply supply extra twist locks on a 40' spreader to handle two 20' containers because it is seldom the case that two 20' containers of the same height are to be handled together. Moreover, two containers removed from a ship's hold will often have to be delivered to separate vehicles at the dockside.

A conventional solution to this problem uses an extendable spreader, one having telescoping side members to permit the spreader to be changed in length to adapt to either a 20' or a 40' container. This does overcome the problem of changing from one spreader to another, but does not overcome the problem of having to handle 20' containers individually. When vertically transporting a single container with the extendable spreader in a long compartment, with the usually limited heel and trim, such container will get stuck in the ship's hold due to undesirable and uncontrollable displacements in the horizontal plane, making handling difficult. Furthermore, it results in an expensive and complex spreader structure and also requires complex hydraulic control apparatus on top of the spreader which adds to its height, a major drawback in some circumstances.

BRIEF DESCRIPTION OF THE INVENTION

To overcome these problems in an effective and economical fashion, an object of the present invention is to provide an apparatus and method for handling cargo containers of two different lengths, including spreaders which can be used independently to engage and lift cargo containers of a smaller size, and of differing heights, and which can be latched together to handle two such containers together, especially from a single ship hold cell, while maintaining full control of their horizontal position even when the ship lists; and which can also be used when latched together, to handle a cargo container of a larger size, the large size container normally being about twice the length of either of the smaller containers.

A further object is to provide first and second spreaders each of which is attachable to a cargo container, the spreaders having interengageable locking means so that a lower one of the containers attached to one of the spreaders can be lifted until the top surfaces of the containers lie in essentially the same plane, whereupon the spreaders can be fixedly locked to each other to permit handling of the spreaders and the two containers as a single entity.

Briefly described, the invention relates to an apparatus for grasping and lifting cargo containers. The apparatus comprises first and second spreaders having generally rectangular bottom surfaces of substantially equal width and length. The length of each bottom surface is substantially equal to the length of the top of a cargo container of a first shorter size. The sum of the lengths thereof corresponds to the length of the top of a cargo container of a second, longer size. Connecting means, vertically extendable from the bottom surfaces, engages the top of at least one cargo container. Coupling means on the spreaders selectively latches the spreaders together end-to-end in a substantially rigid unit independently of the cargo containers when the bottom surfaces of the spreaders lie in substantially the same plane.

In another aspect, the invention includes a method of simultaneously handling two generally rectangular cargo containers having substantially identical lateral dimensions and same or different heights with a single crane. The method comprises the steps of providing two lifting spreaders, each of which has means for engaging the top of a cargo container and a bottom surface of substantially the same shape and size as the cargo container top, coupling the two spreaders together in end-to-end relationship with the bottom surfaces lying in substantially the same plane and with the adjacent ends thereof spaced apart a predetermined distance, placing the two spreaders, as a unit, onto a higher one of the cargo containers such that one of the spreaders rests thereon with the edges of its bottom surface substantially aligned with the top surface edges of the higher container, coupling the one spreader to the higher container, uncoupling the two spreaders, lowering the other of the spreaders onto a second, lower container such that the edges of the bottom surface thereof are substantially aligned with the top surface edges of the second container, coupling the other spreader to the lower container, lifting the lower container with said other spreader until the bottom surfaces of said spreaders are substantially coplanar; coupling the spreaders together; and lifting the spreaders, locked together as a unit, and the two containers coupled to the spreaders.

Other objects, advantages and salient features of the present invention will become apparent from the following detailed description ,which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
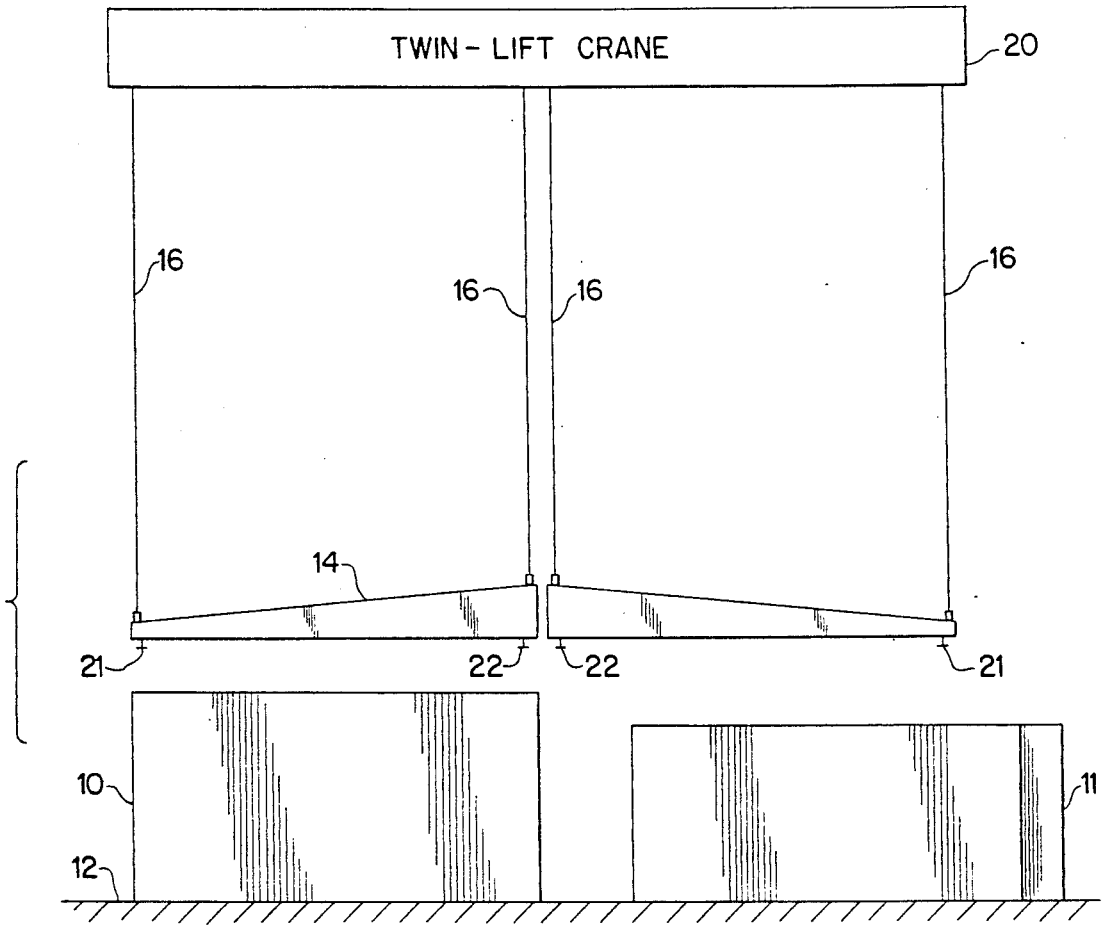
FIG. 1 is a simplified schematic side elevational view of an apparatus in accordance with the invention showing its use in conjunction with two cargo containers.

A typical situation for handling cargo containers is depicted in FIG. 1. Two cargo containers 10 and 11 are depicted resting on a surface such as a pier 12 awaiting transfer to the cargo hold of a vessel. In the situation depicted, the cargo containers, as viewed from the side, are of substantially equal length and width, but the heights of the containers are different. Furthermore, as is commonly the case, the containers are not adjacent each other, and the central longitudinal horizontal axes of the containers are not necessarily aligned. As previously indicated, each container is designed to be received in the cargo hold, and is provided with elongated openings in the corners of the upper surface thereof to receive T-bar twist locks.

The apparatus in accordance with the present invention for engaging and handling these containers includes spreaders 14 and 15 which are generally rectangular frameworks, constructed in a truss-like fashion, with the longer sides thereof formed so that they taper from the contiguous inner ends to the outer ends. The inner ends are adapted to be coupled together. The spreaders are provided with lifting wires or cables 16 connected in suitable fashion to a supporting structure which is part of the lifting mechanism of a twin-lift crane 20.

The crane maintains the spreaders parallel to the ship's bottom. When working over the quay which is not parallel to the ship's hold, the spreaders can operate singly and independently. When hoisted, the spreaders should be aligned and then coupled. The nature of the crane, beyond the characteristics described, is of little consequence to the invention itself.

The wires 16 are connected to the spreaders by conventional connecting means which also form no part of the present invention.

Spreaders 14 and 15 are each provided with four downwardly extendable T-bar twist lock connectors including a pair of connectors 21 at the outer ends of each of the spreaders and another pair of connectors 22 at each of the inner, or mating ends of the spreaders. Connectors 22 are vertically extendable and retractable connectors, the details of which will be further described. Connectors 21 need not be retractable, but can be retractable. It will be sufficient at this stage to note that they are retractable so that they do not protrude beyond the bottom surfaces of the spreaders, and that they are controllable in pairs so that, in each spreader, the connectors 21 can be extended and rotated with connectors 22 retracted to provide for the handling of cargo containers.

Each spreader is provided, at its mating inner end, with coupling means indicated generally at 23 by which the spreaders can be coupled to each other, released, or partly coupled for purposes of adjusting the relationship between the spreaders and the cargo containers to be lifted thereby. A specific embodiment of coupling means will be described in greater detail hereinafter.

Connectors 21 and 22 and coupling means 23 are all under the control of the operator of crane 20 through suitable electrical, pnuematic and/or hydraulic controls, not illustrated, which are also conventional in this field. Thus, the crane operator can independently control the action of the coupling means and the extension and rotation of the T-bar connectors.

As shown in FIG. 1, the disposition and structure of the containers is such that they cannot be simultaneously lifted by a conventional spreader mechanism. Thus, for clarity of understanding, a typical sequence of events in the handling of containers of this situation will be described.

Having identified the specific cargo containers which are to be conveyed to the vessel, the crane operator lowers the spreader 14 and aligns spreader 14 with cargo container 10 which is the taller or higher of the two containers. Spreader 14 is lowered and aligned until the extended twist lock connectors are aligned with the elongated openings in the top of container 10. The T-bar connectors on the lower surface of spreader 14 pass through the elongated holes, and are then rotated 90° so that they cannot emerge from those holes. Spreader 14 is then firmly coupled to container 10.

Figure 2:
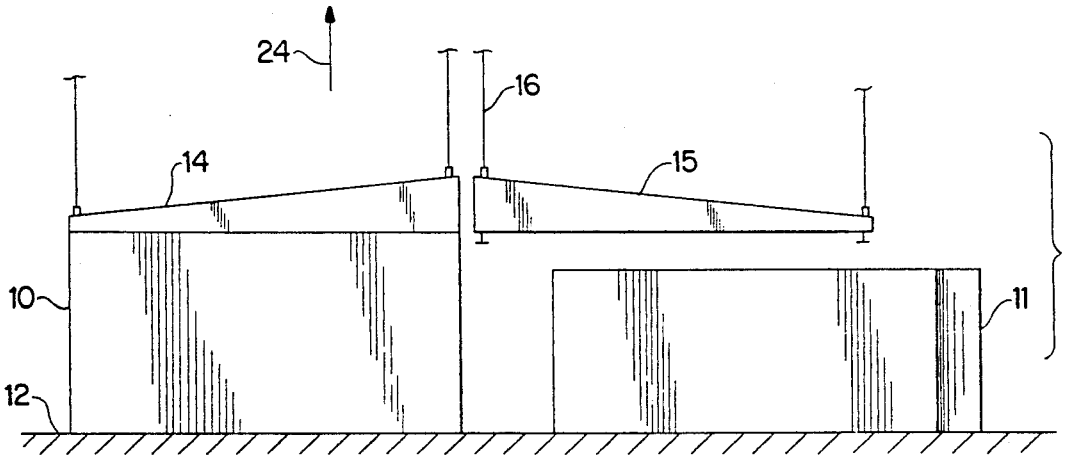
FIGS. 2–6 are schematic side elevational views of the apparatus of FIG. 1 showing a typical sequence of steps in the use thereof.
Figure 3:
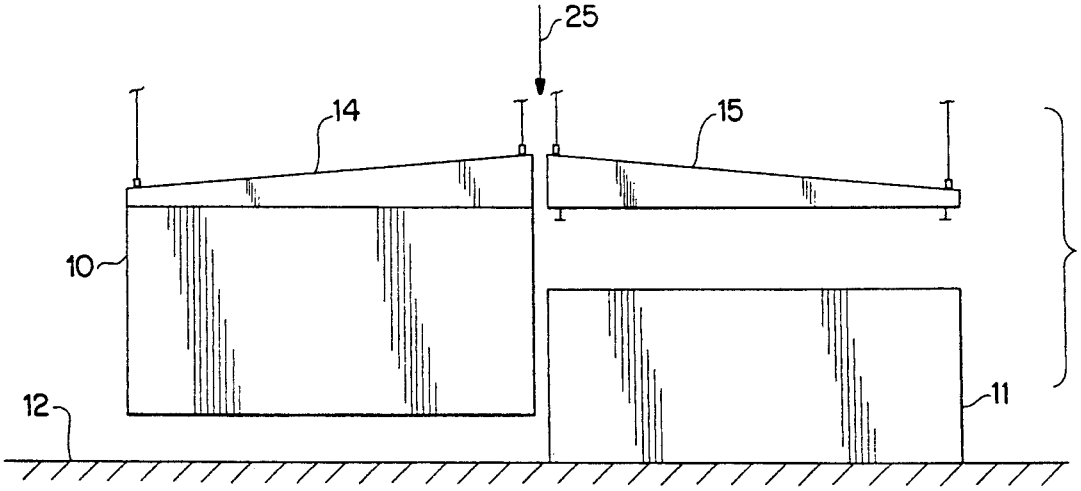
Figure 4:
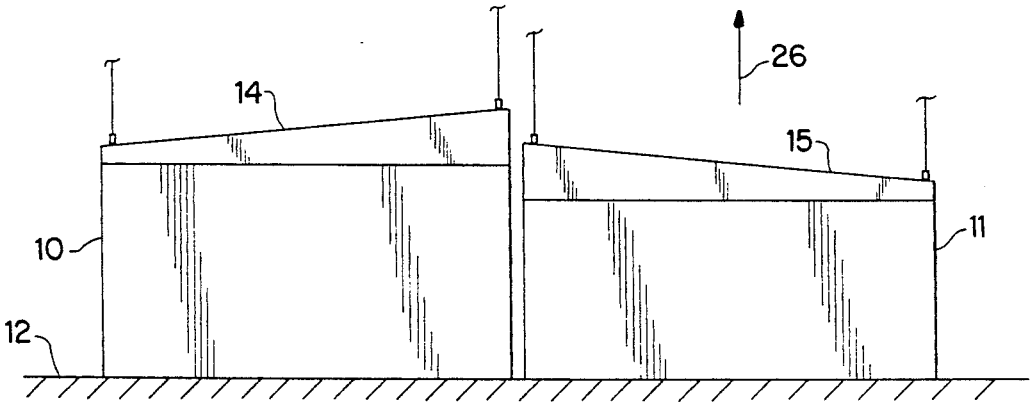
Figure 5:
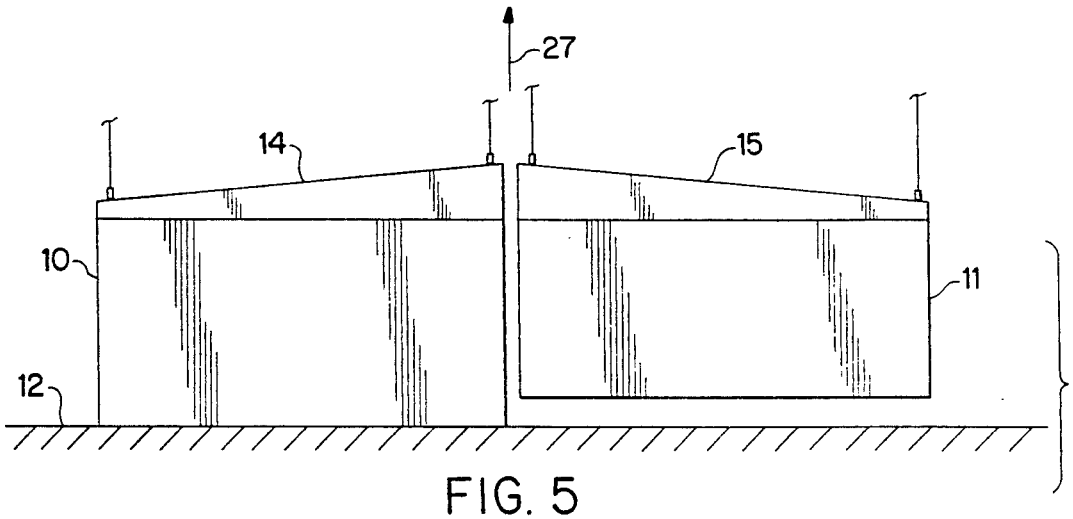

This situation is depicted in FIG. 2 which shows spreader 14 coupled to container 10 in a position to lift that container, as indicated by arrow 24. Container 10 is then lifted. This operation is then repeated with spreader 15 in connection with container 11 as spreader 15 is separated from spreader 14 and 13 is lowered, as indicated by arrow 25. Spreader 15 is then raised, as indicated by arrow 26 (FIG 4), until the tops of containers 11 and 12 are level. As illustrated in FIG. 5, the spreaders and containers are subsequently raised together, as indicated by arrow 27. When both spreaders are hoisted against the crane, the spreaders can be coupled by connectors 23. The coupling means maintains the adjacent ends of the spreaders in a spaced relationship, the spacing therebetween being, normally, on the order of 76 mm. or 3".

To enlarge on this point, a ship's hold is most commonly equipped with cells designed to receive containers which are 40' long. A container which is referred to as a 40' container actually measures 40' in overall length, but a container which is a standardized nominal 20' container actually is only 19'10-½" long. Thus, in order for the overall length occupied by two 20' containers to be suitable for a 40' cell, a 3" spacing between the containers is necessary. As indicated, this is provided by the coupling means between the spreaders.

Figure 6:
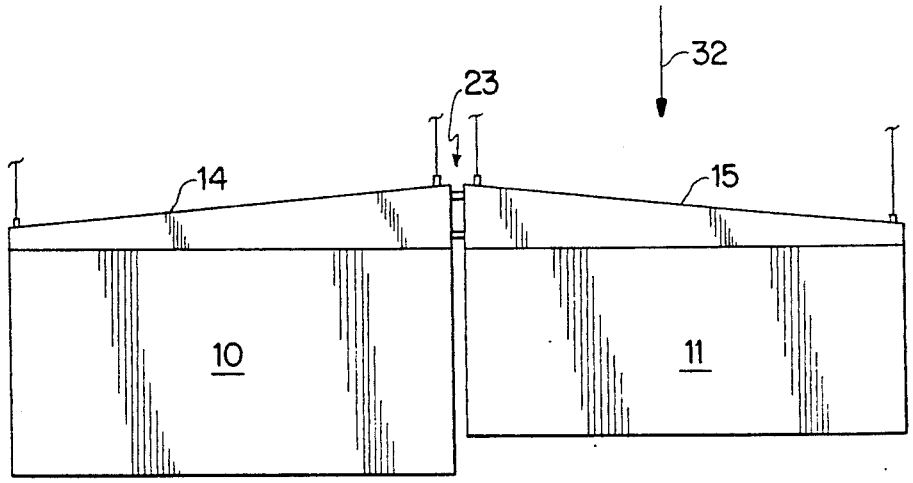

FIG. 6 schematically illustrates the spreaders and container after being lifted by a suitable distance by the crane, and the coupling means 23 being activated to lock the spreaders and containers together for handling as a single unit. The unit can then be lowered into a cell designed to receive one or more cargo containers having a length equal to the overall assembly described. The spreaders and cargo containers are then lowered into the cell until the bottom surface of the taller container 10 rests upon either the bottom of the cell or upon the top surface of a cargo container previously placed in the cell. Coupling means 23 can then be activated to disengage the spreaders from each other so that cargo container 11 can be further lowered to rest upon either the bottom of the cell or a cargo container previously placed therein, as indicated by arrow 32. The twist locks of spreader 15 are then disengaged from container 11 and spreader 15 is again brought into horizontal alignment with spreader 14 so that the coupling means 23 can be activated to again lock the spreaders to each other. The twist locks on spreader 14 can then be disengaged from cargo container 10, permitting the assembly including the two locked-together spreaders to be removed from the cell to load more cargo containers into the cell or other similar cells on the ship.

As will be recognized from the above description, the process of unloading a ship is substantially the reverse of that described, and no detailed description of the sequence of steps appears to be necessary.

Figure 7:
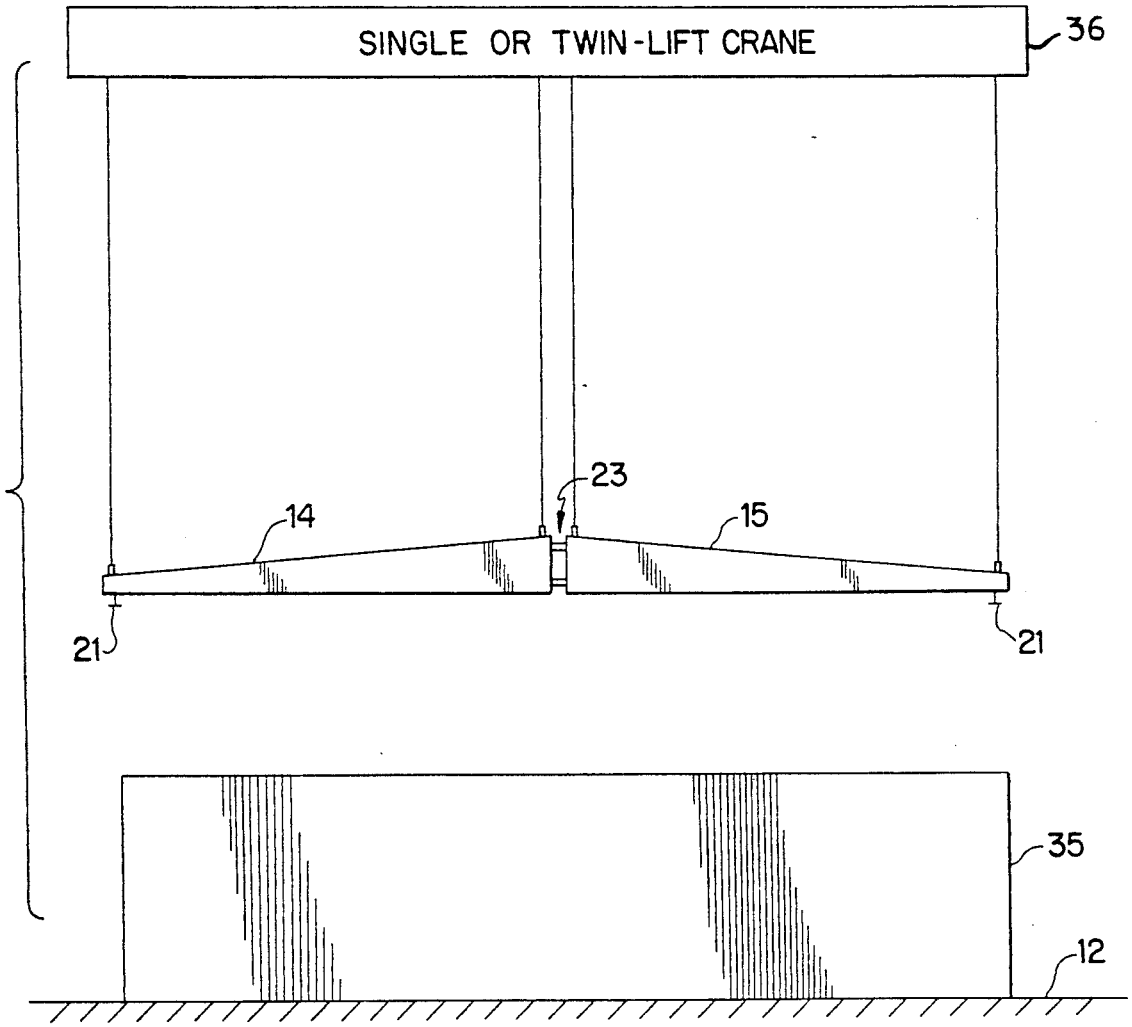
FIG. 7 is a schematic side elevational view showing the apparatus of the invention in use with a single longer cargo container.

The apparatus of the present invention is also suitable for handling the single 40' container as illustrated in FIG. 7. As shown therein, a 40' cargo container 35 rests on pier 12 and awaits handling by the spreader assembly. For this purpose, coupling means 23 is activated to hold the spreaders together as a single unit, functionally converting the spreader into a single 40' spreader. Also for this purpose, T-bar connectors 21 are used, but connectors 22 remain retracted within the spreader since the openings to receive the twist lock connectors are provided only at the corners of cargo containers and not in the middle thereof. The procedure for lifting the 40' container is self-evident in that it is only necessary to lower the latched spreader assembly onto the top surface of container 35, engage the twist locks therein, and lift the container into or out of the vessel.

Figure 8:
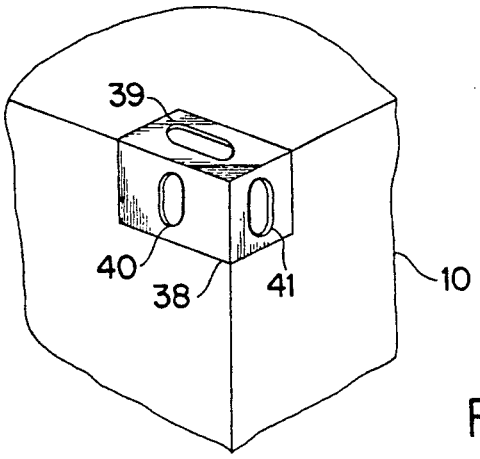
FIG. 8 (PRIOR ART)
FIG. 8 is a perspective view of a typical cargo container corner casting.

Although such structure is conventional, a typical corner casting on a cargo container is shown in the fragmentary view of FIG. 8 wherein only a corner of a cargo container such as container 10 is illustrated. The corner casting 38 is frequently made so that it has an elongated opening 39 in the upper horizontal surface thereof, and additional openings 40 and 41 in the two side portions thereof. For purposes of the present invention, only opening 39 is of interest. Openings 40 and 41 can be used, if desired, to latch the structure firmly into the cargo cell of the ship to prevent any lateral movement of the container while the ship is under way, but this, again, forms no part of the present invention. The corner casting 38 is, of course, integrally connected with the structure of the cargo container itself so that lifting at the corners permits lifting of the entire container with the design load for which the container is intended. Commonly, corner castings of this type are provided at each of the eight corners of the cargo container.

Figure 9:
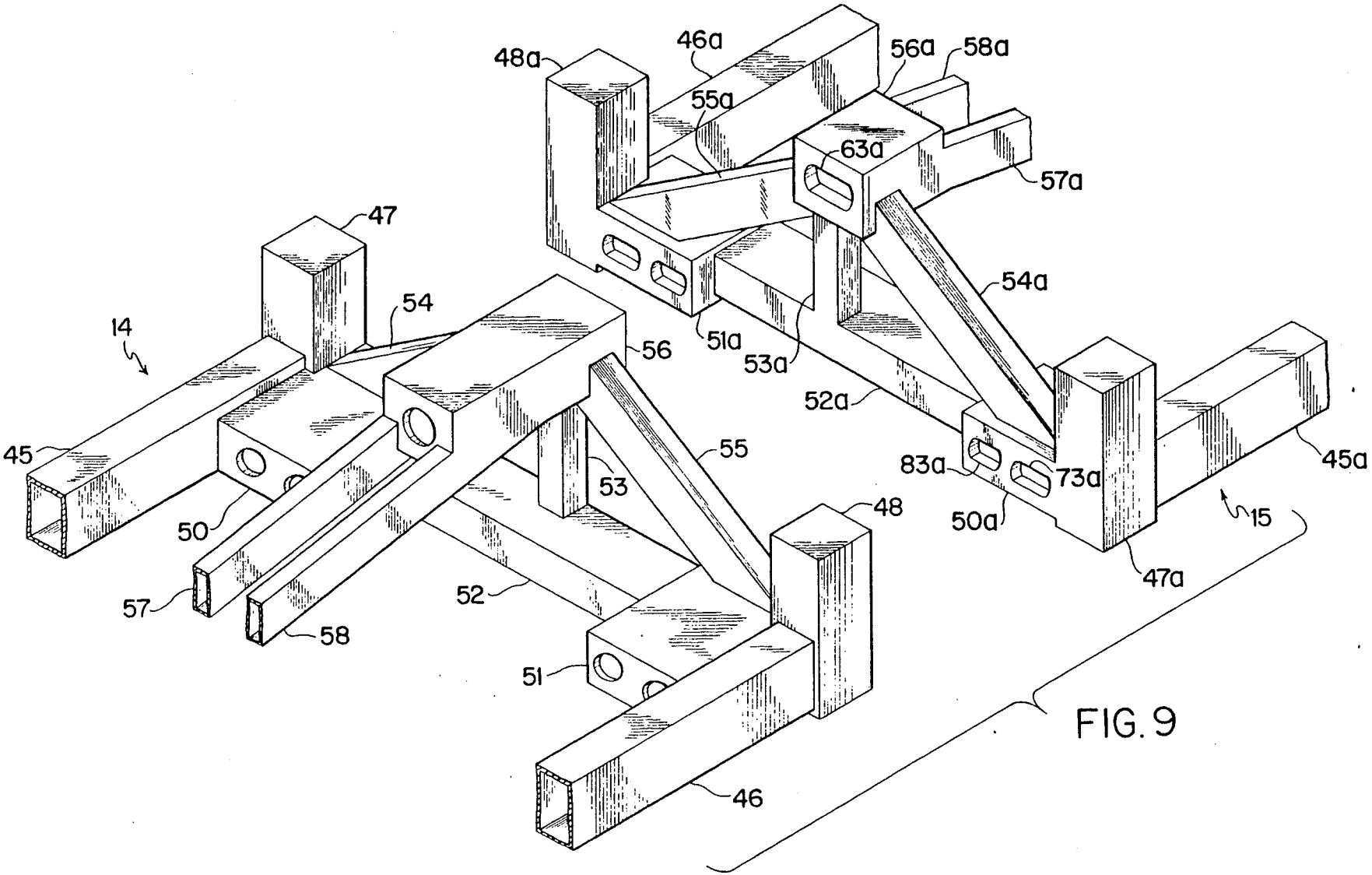
FIG. 9 is an enlarged partial perspective view of spreader mechanisms in accordance with the invention showing the locking means location.

A specific embodiment of spreader structures usable in the manner described in connection with FIGS. 1–8 is seen in FIGS. 9–14. FIG. 9 provides a fragmentary perspective view of the mating inner ends of two spreaders 14 and 15. Spreader 14 is a generally rectangular framework having side beams 45 and 46. At the forward, or mating, ends of beams 45 and 46 are generally rectangular housings 47 and 48 which contain vertically extendable and retractable twist locks, this being the pair of locking means 22 referred to in connection with FIGS. 1–7. Thus, at the bottom end of each of housings 47 and 48, there is provided an elongated opening 43 to permit the T-shaped locking device to pass therethrough. At the inward sides of housing 47 and 48 and beams 45 and 46, there are provided housings 50 and 51, at least one of which can contain extendable locking means for engaging the other spreader. A transverse beam 52 extends between housings 50 and 51 to form the remaining side of the forward end of the spreader. A vertical support post 53 extends upwardly and inwardly from housings 50 and 51 to support a housing 56 which can contain an upper extendable locking device. Diagonal rearwardly extending beams 57 and 58 are attached to the rear end of housing 56 and are connected to other structural members of the spreader, as will be illustrated and described later.

Spreader 15 is similarly constructed, having side beams, housings, transverse and rearwardly extending beams, all of which are identified by the same reference numerals used in connection with spreader 14, but with the addition of the letter "a".

The face of spreader 14, not visible in FIG. 9, presents substantially the same appearance as the mating face of spreader 15, and the various structural components thereof described thus far are substantially identical. However, spreader 14 is provided with extendable and retractable, and in some cases rotatable, locking devices which are extendable toward spreader 15 to engage portions thereof, whereas the housings 50*a*, 51*a* and 56*a* of spreader 15 are intended only to receive the active portions of the various locking devices. Thus, while the spreaders are, and can be, manufactured so as to be nearly identical, the components placed therein are somewhat different.

Figure 10:
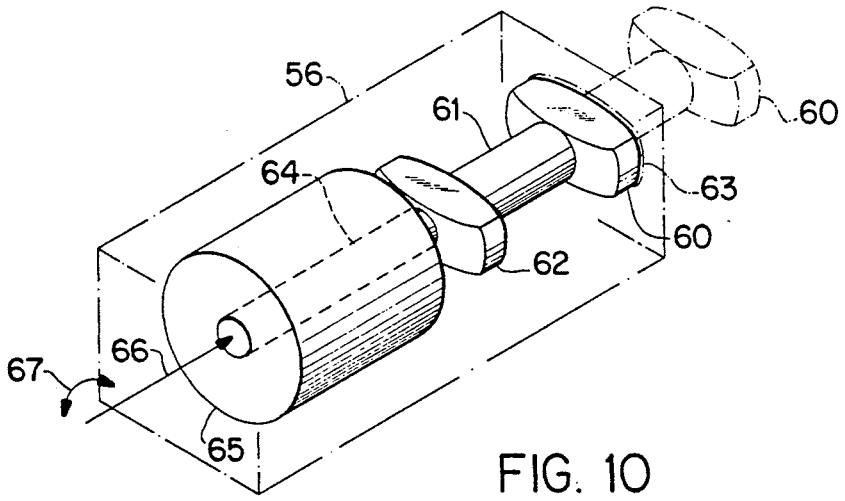
FIG. 10 is a cutaway perspective view of an upper locking device usable in the apparatus of FIG. 9.

FIG. 10 illustrates the contents of a housing 56, showing the extendable and rotatable locking device included therein, the outline of the housing itself being shown in phantom lines. The locking device includes a locking head 60 which is fixedly attached to a shaft 61, the other end of which is fixedly attached to a second locking head 62. Each of heads 60 and 62 forms a T-shaped relationship with shaft 61. Housing 56 is provided with an opening 63, as previously indicated, to permit head 60 to pass therethrough. A similar elongated opening 63*a* in spreader 15 is dimensioned to receive head 60. The other surface of head 62 is fixedly attached to a drive shaft 64 which is coupled to a drive motor 65 which can be an hydraulic drive motor for moving shafts 64 and 61 axially to extend the locking head beyond the end face of housing 56, as indicated by arrow 66, and to then rotate the locking head through an angle of 90° as indicated by arrow 67. While fluid actuated devices of a conventional nature can advantageously be used for this purpose, it will be recognized that other forms of powered mechanisms can be employed for this purpose. For example, a piston and cylinder assembly could be used for extending the head and an electric motor and gear train used for rotating the head. In any event, the head is extended until it passes through opening 63*a* in the mating spreader and then is rotated 90° to prevent retraction thereof, thereby locking the upper ends of the spreaders together.

It will be observed that the spacing between locking heads 60 and 62, defined by the length of shaft 61, represents the desired ultimate spacing between the inner surfaces of the end plates of housings 56 and 56*a*. Thus, head 62 remains within housing 56 and engages the inner surface thereof adjacent opening 63, while head 60 assumes a similar position within housing 56*a* on the opposite spreader. This mechanically latches the two spreaders in the desired relationship, preventing them from moving apart while allowing a limited possibility for the spreaders to move closer together at this point, and avoids the need for relying upon the electrical or hydraulic drive mechanisms involved in motor 65 from accomplishing the locking function. Thus, power need not be maintained on the apparatus once it is locked into position.

Figure 11:
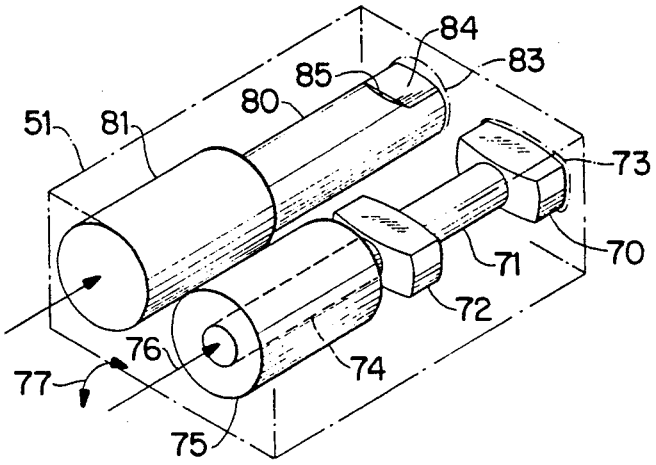
FIG. 11 is a cutaway perspective view of one of the lower locking mechanisms usable in the apparatus of FIG. 9.

FIG. 11 illustrates housing 51 in phantom lines and shows its contents. Included therein is a locking head 70 attached to a shaft 71 and a second locking head 72 at the opposite end of shaft 71. Head 72 is connected to shaft 71. Shaft 71 is driven axially and through 90° of rotation by a drive motor 75 as indicated by arrows 76 and 77. This structure forms a locking device which can be extended through opening 73 and rotated in the same fashion as described in connection with FIG. 10, except that head 70 passes through an opening 73*a* in housing 50*a* of spreader 15. This system prevents the spreaders from moving apart, while allowing the spreaders to move closer together.

Housing 51 also includes a push rod 80 which is coupled to a drive motor 81, which can be a piston and cylinder assembly, for axially extending and retracting rod 80 through an opening 83 in the end of housing 51. The distal end of rod 80 is provided with upper and lower flattened surfaces 84 which are capable of entering an elongated opening 83*a* in housing 50*a*, the flattened surfaces terminating in chamfered surfaces 85 which contact the upper and lower flattened sides of opening 83*a* to exert a pushing force thereagainst. Again, the spacing between heads 70 and 72 is substantially equal to the desired spacing between the spreaders in their locked-together state, and the pushing action of rod 80, when it is extended to contact the mating spreader, prevents any movement thus far allowed by heads 70 and 72 and shaft 71. In this way, the two spreaders may move relative to each other to a limited extent to facilitate simultaneous engagement to a set of 20 foot containers in a single cell, which containers are slightly out of line.

As will be recognized, housing 50 contains devices the same as shown in FIG. 11, except that the devices are reversed so that the push rod 80 lies inboard of the locking head mechanism.

Figure 12:
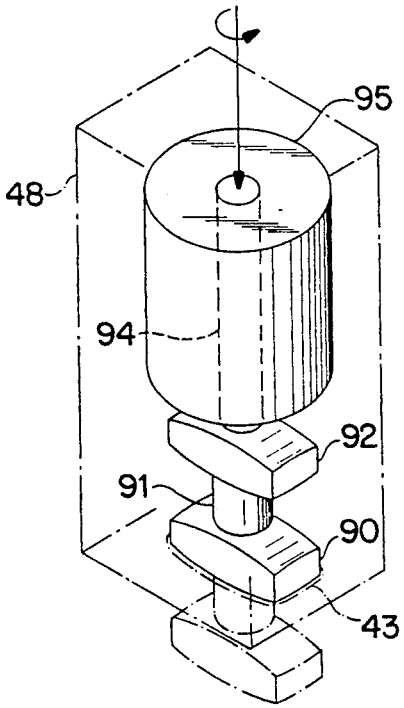
FIG. 12 is a cutaway perspective view of a container locking mechanism usable in the apparatus of FIG. 9.

FIG. 12 shows the apparatus contained within a corner housing 48, and the contents of the other corner housings 47, 47*a*, 48*a*. This structure will be seen to be substantially identical to the apparatus of FIG. 10 to include locking heads 90 and 92, shafts 91 and 94, and a linear and rotational drive mechanism 95. Housing 48 has an elongated end opening 43, as previously described. It will be observed that there are two significant differences between the mechanism in housing 48 and that within housing 56. One of these differences is that the axis of operation of the mechanism is vertical rather than horizontal. The other difference is that the spacing between heads 90 and 92 is somewhat less than that between heads 60 and 62 or 70 and 72. The reason for this is that, when the spreader is locked to its associated container, the bottom surface of housing 48, and the other similar housing, is expected to be in contiguous parallel relationship with the corner casting on the container, rather than spaced therefrom as is the case with the spreaders.

When locking the spreaders together, the sequence of normal operations would be to align the spreaders so that the end surfaces of the housings 50, 51 and 56 are in parallel relationship with the adjacent surfaces of housing 50*a*, 51*a* and 56*a*, the planes containing these surfaces being spaced apart by a predetermined distance as previously described. Motors 81 are then actuated, causing the push rods 80 to extend and pass into openings 83*a* to align the mating ends of the two spreaders more precisely. Motors 65 and 75 are subsequently actuated to cause the locking heads to extend axially.

When the locking heads have passed through the associated openings in the opposite spreader, the motors are actuated to cause the heads to rotate through a 90° angle, thereby preventing the locking heads from being extracted from those openings and locking the spreaders in the longitudinal direction.

It is important to note that the locking mechanism housings are arranged at the apices of a triangle, providing a secure and rigid structural relationship between the spreaders when they are coupled together to function as a single unit with either one or two containers being carried. When hoisting two 20' containers, rigidity about the vertical axis and synchronous movement in the vertical direction are necessary. When lifting a 40' container, rigidity about the horizontal transverse axis is necessary.

As previously indicated, the operation of motors within housings 48, 47, and the like, is independent of the operation of the locking mechanism, and the use thereof is in conjunction with the description of FIGS. 1-7.

It will also be recognized that it is possible to provide the apparatus of FIG. 11 in housing 51 on one spreader and in housing 51*a* on the opposite spreader, leaving housings 50 and 50*a* to be those which contain no operating mechanism but which are designed to receive the locking heads of the oppositely disposed devices. However, only one of housings 56 and 56*a* can be provided with the apparatus shown in FIG. 10.

Figure 13:
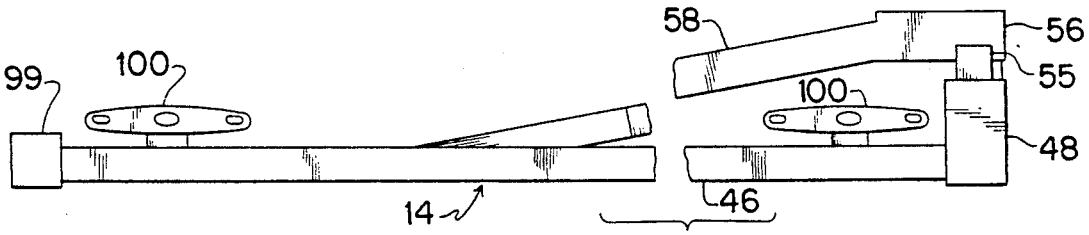
FIG. 13 is a partial side elevational view of one of the spreaders shown in FIG. 9.
Figure 14:
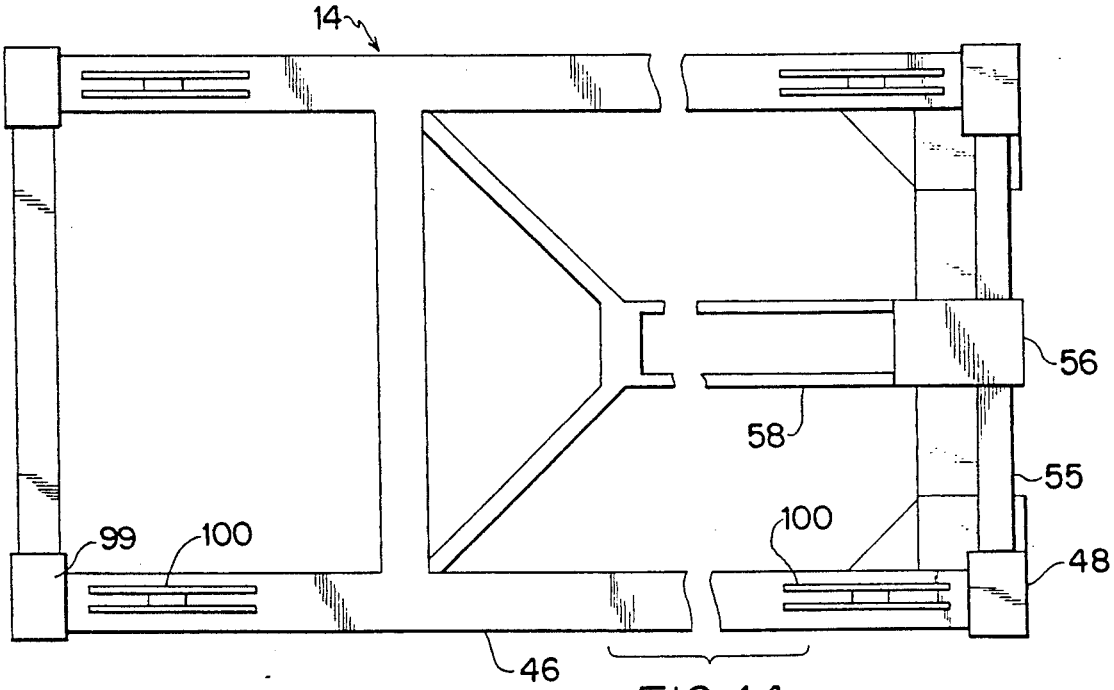
FIG. 14 is a top plan view of the spreader of FIG. 13.

FIGS. 13 and 14 illustrate the overall structure of a typical spreader usable in conjunction with this apparatus. Also shown in FIGS. 13 and 14 are housings 99 at the outer ends of the spreaders, and force equalizing beams 100 to which the cables for lifting the spreader can be attached in pairs, if suitable, depending on the construction of the crane winches. Housings 99 can contain twist locks which are not extendable, i.e., which are rotatable only. This is feasible because, again with reference to FIGS. 1-7, the end twist locks 21 are used regardless of whether a 20' or a 40' container is being handled. Thus, there is no need to retract those end twist locks, and they can be permitted to remain protruding at all times. Thus, the housings therefor can be made somewhat shorter. The remaining beams and structural elements of the spreader are shown only for the sake of completeness and will not be described in detail. As will be recognized, the overall structure thereof can be formed by welding or other conventional construction techniques.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for grasping and lifting cargo containers, comprising:

first and second rigid spreaders having generally rectangular bottom surfaces and substantially equal and fixed widths and lengths, the length of each of said bottom surfaces being substantially equal to a length of a cargo container of a first shorter standard size, and the sum of the lengths thereof being no greater than a length of a cargo container of a second, longer standard size;

connecting means vertically extendable from said bottom surfaces for engaging the top of at least one cargo container, said connecting means located at adjacent ends of said spreaders being retractable to positions above said bottom surfaces;

coupling means on said spreaders for selectively latching said spreaders together end-to-end and for restraining relative movement of said spreaders in horizontal and vertical directions to form a substantially rigid unit independently of said cargo containers when the bottom surfaces of said spreaders lie substantially in a single plane, said coupling means on each of said spreaders including, at one end thereof, a plurality of housings, each of said housings having a planar end surfaced, said end surfaces on each spreader lying in substantially a single plane; and locking means, on at least one of said spreaders, extendable from at least two of said housings thereon, at least two of the housings of the other of said spreaders including means defining openings for receiving said locking means;

whereby said first and second spreaders are rigidly coupled by said coupling means for handling one cargo container of the longer standard size and for simultaneously handling two cargo containers of the shorter standard size, but can be released by said coupling means for handling two cargo containers of the shorter standard size having different heights independently or in tandem.

2. An apparatus according to claim 1 wherein said openings are elongated and noncircular; and said locking means includes an extendable noncircular locking head dimensioned to pass through one of said openings, said locking head being rotatable.

3. An apparatus according to claim 1 wherein said coupling means comprises a plurality of longitudinally extendable lock bars mounted in an end wall of at least one end of said spreaders; and the other of said spreaders includes recesses shaped to closely receive said bars only when the bottom surfaces of said spreaders are coplanar and said spreaders are in end-to-end relationship.

4. An apparatus according to claim 1 wherein said coupling means comprises remotely operable means.

5. An apparatus according to claim 1 wherein said locking means are vertically spaced from each other.

6. An apparatus according to claim 1 wherein said spreaders comprise generally rectangular horizontal frames and vertical frames extending upwardly from adjacent ends of said horizontal frame.

7. An apparatus according to claim 6 wherein said horizontal and vertical frames support said locking means at vertically spaced locations.

8. An apparatus according to claim 6 wherein said vertical frames are generally triangular.

9. An apparatus according to claim 8 wherein said locking means are located adjacent apexes of said vertical frames.

10. An apparatus for grasping and lifting cargo containers, comprising:

first and second rigid spreaders having generally rectangular bottom surfaces and substantially equal and fixed widths and lengths, the length of each of said bottom surfaces being substantially equal to a length of a cargo container of a first shorter standard size, and the sum of the lengths thereof being no greater than a length of a cargo container of a second, longer standard size;

connecting means vertically extendable from said bottom surfaces for engaging the top of at least one cargo container, said connecting means located at adjacent ends of said spreaders being retractable to positions above said bottom surfaces; and coupling means on said spreaders for selectively latching said spreaders together end-to-end and for restraining relative movement of said spreaders in horizontal and vertical directions to form a substantially rigid unit independently of said cargo containers when the bottom surfaces of said spreaders lie substantially in a single plane, said coupling means on each of said spreaders including first, second and third housings, each of said housing having a substantially planar end surface and a noncircular opening through each of said end surfaces, said housings being disposed symmetrically such that, when two of said spreaders are placed end-to-end, said housings on one spreaders lie opposite the housings on the other spreader with said end surfaces in substantially relationship, said coupling means including locking members mounted in and extendable from the housings on one of said spreaders, said locking means having locking heads dimensioned to pass through the openings in the housings on the other of said spreaders, said locking members being rotatable after passage through said openings to prevent withdrawal of said heads whereby said spreaders are prevented from moving away from each other;

whereby said first and second spreaders are rigidly coupled by said coupling means for handling one cargo container of the longer standard size and for simultaneously handling two cargo containers of the shorter standard size, but can be released by said coupling means for handling two cargo containers of the shorter standard size having different heights independently or in tandem.

11. An apparatus according to claim 10 wherein said coupling means further includes means, mounted on one of said spreaders and extendable therefrom beyond the plane containing said end surfaces, for exerting and pushing force tending to urge said spreaders apart.

12. An apparatus according to claim 10 wherein at least one of said housings on each said spreader is vertically spaced from the other housings on that spreader.

13. An apparatus according to claim 10 wherein said coupling means comprises a plurality of longitudinally extendable lock bars mounted in an end wall of at least one of said spreaders; and the other of said spreaders includes recesses shaped to closely receive said bars only when the bottom surfaces of said spreaders are coplanar and said spreaders are in end-to-end relationship.

14. An apparatus according to claim 10 wherein said coupling means comprises remotely operable means.

15. An apparatus for grasping and lifting cargo containers, comprising:

first and second rigid spreaders having generally rectangular bottom surfaces and substantially equal and fixed widths and lengths, the length of each of said bottom surfaces being substantially equal to a length of a cargo container of a first shorter standard size, and the sum of the lengths thereof being no greater than a length of a cargo container of a second, longer standard size;

connecting means vertically extendable from said bottom surfaces for engaging the top of at least one cargo container, said connecting means located at adjacent end of said spreaders being retractable to positions above said bottom surfaces;

coupling means on said spreaders for selectively latching said spreaders together end-to-end and for restraining relative movement of said spreaders in horizontal and vertical directions to form a substantially rigid unit independently of said cargo containers when the bottom surfaces of said spreaders lie substantially in a single plane, said coupling means on each of said spreaders including, at one end thereof, a plurality of housings, each of said housing having a planar end surface with an elongated, noncircular opening, said end surfaces on each spreader lying in substantially a single plane; and locking means on at least one of said spreaders extendable from at least two of said housings thereon, each said locking means including an extendable member with two paced locking heads and, in a locking condition, said two locking heads of each said locking means being positioned in housings on different ones of said spreaders;

whereby said first and second spreaders are rigidly coupled by said coupling means for handling one cargo container of the longer standard size and for simultaneously handling two cargo containers of the shorter standard size, but can be released by said coupling means for handling two cargo containers of the shorter standard size having different heights independently or in tandem.

16. An apparatus for grasping and lifting cargo containers, comprising:

first and second spreaders having generally rectangular bottom surfaces and substantially equal widths and lengths, the length of each of said bottom surfaces being substantially equal to a length of a cargo container of a first shorter standard size, and the sum of the lengths thereof being no greater than a length of a cargo container of a second, longer standard size;

connecting means vertically extendable from said bottom surfaces for engaging the top of at least one cargo container; and coupling means on said spreaders for selectively latching said spreaders together end-to-end and for restraining relative movement of said spreaders in horizontal and vertical directions to form a substantially rigid unit independently of said cargo containers when the bottom surfaces of said spreaders lie substantially in a single plane, said coupling means on each of said spreaders including at one end thereof, a plurality of housings, each of said housing having a planar end surface, said end surfaces on each spreader lying in substantially a single plane, at least one of said spreaders including locking means extendable from at least two of said housings thereon, at least two of the housings of the other of said spreaders including means defining elongated and noncircular openings for receiving said locking means, each said locking means including a first extendable noncircular locking head being dimensioned to pass through one of said openings and being rotatable;

whereby said first and second spreaders are rigidly coupled to said coupling means for handling one cargo container of the longer standard size and for simultaneously handling two cargo containers of the shorter standard size, but can be released by said coupling means for handling two cargo containers of the shorter standard size having different heights independently or in tandem.

17. An apparatus according to claim 16 wherein said coupling means on each said spreader comprises three of said housings which are disposed symmetrically.

18. An apparatus according to claim 16, wherein each said locking means comprises a second, noncircular locking head spaced from said first locking head.

* * * * *